US012680495B2

(12) United States Patent
Noda et al.

(10) Patent No.: US 12,680,495 B2
(45) Date of Patent: Jul. 14, 2026

(54) ENGINE

(71) Applicant: Yanmar Holdings Co., Ltd., Osaka (JP)

(72) Inventors: Takehiro Noda, Osaka (JP); Yoshimitsu Matsuura, Osaka (JP); Hiroshi Kashiwabara, Osaka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 0 days.

(21) Appl. No.: 18/387,040

(22) Filed: Nov. 5, 2023

(65) Prior Publication Data

US 2024/0200486 A1 Jun. 20, 2024

(30) Foreign Application Priority Data

Dec. 19, 2022 (JP) ..... 2022-201694

(51) Int. Cl.
*F01P 3/02* (2006.01)
*F01P 3/12* (2006.01)

(52) U.S. Cl.
CPC ..... *F01P 3/02* (2013.01); *F01P 2003/021* (2013.01); *F01P 3/12* (2013.01)

(58) Field of Classification Search
CPC ..... F01P 3/02; F01P 3/12; F01P 2003/021
See application file for complete search history.

(56) References Cited

U.S. PATENT DOCUMENTS 4,346,676 A * 8/1982 Tyner ..... F02F 7/0012 123/41.31
6,471,559 B2 * 10/2002 Kashima ..... F02B 75/22 60/321
2009/0044930 A1 * 2/2009 Hazelton ..... F02B 77/11 165/136

* cited by examiner

*Primary Examiner* — Syed O Hasan
(74) *Attorney, Agent, or Firm* — Chris Mizumoto

(57) ABSTRACT

An exemplary engine is a V-type engine including a first bank and a second bank arranged side by side in a left-right direction, the engine including: a first cooling liquid passage and a second cooling liquid passage disposed between the first bank and the second bank and extending in a front-rear direction; and an exhaust passage disposed between the first bank and the second bank and extending in a front-rear direction and disposed below the first cooling liquid passage and the second cooling liquid passage.

6 Claims, 9 Drawing Sheets

ENGINE

CROSS-REFERENCE

This application claims foreign priority of JP2022-201694 filed Dec. 19, 2022, the disclosure of which is hereby incorporated by reference in its entirety.

TECHNICAL FIELD

The present invention relates to an engine.

BACKGROUND ART

Conventionally, a V-type engine in which an exhaust passage is disposed in an upper portion of the engine is known (see, for example, Patent Document 1). In Patent Document 1, left and right exhaust pipes disposed in the upper portion of the engine are disposed between left and right banks in a plan view from above.

PRIOR ART DOCUMENT

Patent Document

Patent Document 1: Japanese Unexamined Patent Application Publication No. 2020-522646

SUMMARY OF INVENTION

Technical Problem

Incidentally, an electronic control component such as an injector and an intake port for intake air may be disposed in the upper portion of the engine. When the exhaust passage is disposed in the upper portion of the engine, heat from the exhaust passage may be transmitted to the electronic control component, an intake portion for intake air, and the like, and thereby, affect the operation of the component itself or the engine.

An object of the present invention is to provide a technique, in a V-type engine, capable of suppressing the influence of heat from an exhaust passage on the surroundings.

Solution to Problem

An exemplary engine of the present invention is an engine that is a V-type engine including a first bank and a second bank arranged side by side in a left-right direction, the engine including: a first cooling liquid passage and a second cooling liquid passage disposed between the first bank and the second bank and extending in a front-rear direction; and an exhaust passage disposed between the first bank and the second bank and extending in a front-rear direction and disposed below the first cooling liquid passage and the second cooling liquid passage.

Advantageous Effects of Invention

According to the exemplary present invention, in a V-type engine, it is possible to suppress the influence of heat from an exhaust passage on the surroundings.

DESCRIPTION OF EMBODIMENTS

Figure 1:
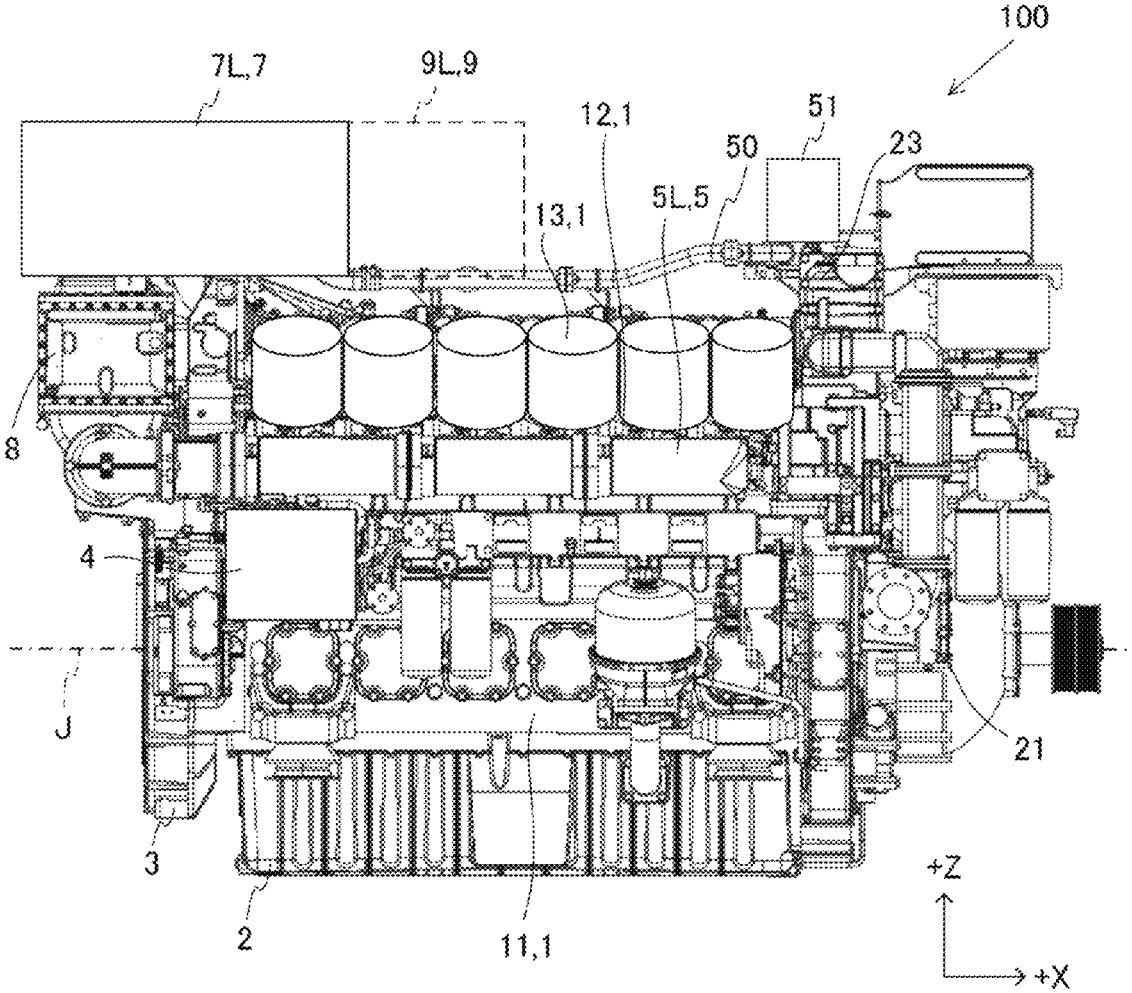
FIG. 1 is a left side view showing a schematic configuration of an engine.

Hereinafter, an exemplary embodiment of the present invention will be described in detail with reference to the drawings. In the drawings, an XYZ coordinate system is shown as a 3D orthogonal coordinate system, as appropriate. In the following description, an X direction is defined as a front-rear direction, a Y direction is defined as a left-right direction, and a Z direction is defined as an up-down direction. A +X side is defined as a front side, and a −X side is defined as a rear side. A +Y side is defined as a left side, and a −Y side is defined as a right side. A +Z side is defined as an up side, and a −Z side is defined as a down side. Specifically, a direction in which a center line J of a crankshaft (output shaft) shown in FIG. 1 extends is defined as the front-rear direction. A side on which a cylinder block 11 is disposed with respect to a fly wheel (not shown) accommodated in a fly wheel housing 3 is defined as the front side. The up-down direction is defined with a side on which an oil pan 2 is disposed with respect to the cylinder block 11 being the down side. A direction orthogonal to the front-rear direction and the up-down direction is defined as the left-right direction, and the left side when viewed from the front toward the rear is defined as the left side and the right side when viewed from the front toward the rear is defined as the right side. These notations of directions are merely used for the purpose of explanation, and are not intended to limit an actual positional relationship and actual directions.

1. Overview of Engine

Figure 2:
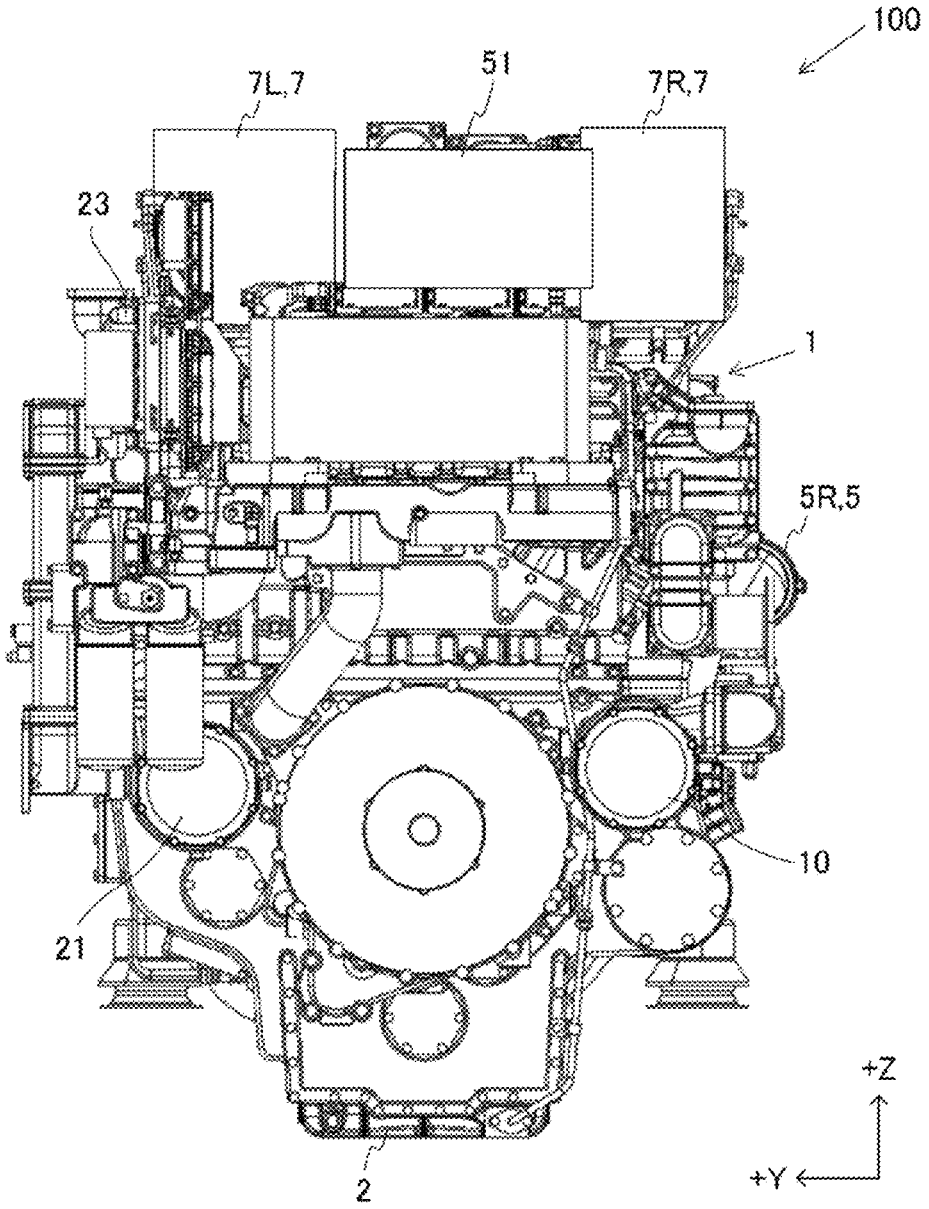
FIG. 2 is a front view showing the schematic configuration of the engine.
Figure 3:
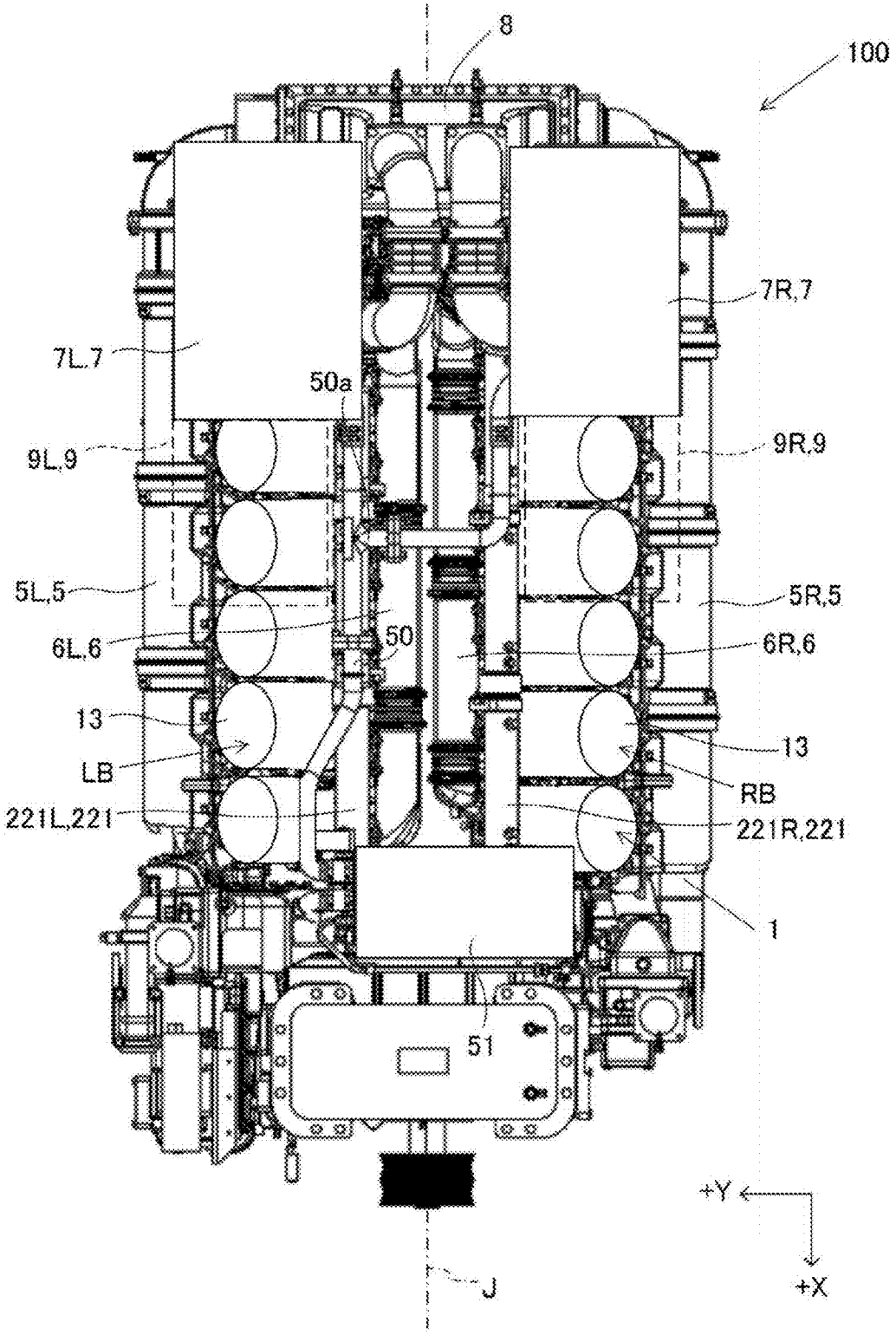
FIG. 3 is a plan view showing the schematic configuration of the engine.

FIG. 1 is a left side view showing a schematic configuration of an engine 100 according to an embodiment of the present invention. FIG. 2 is a front view showing the schematic configuration of the engine 100 according to the embodiment of the present invention. FIG. 3 is a plan view showing the schematic configuration of the engine 100 according to the embodiment of the present invention. An outline of the engine 100 will be described with reference to FIGS. 1 to 3.

Although not particularly limited, the engine 100 may be, for example, an engine used for power generation or a ship propulsion engine used for ship propulsion. The engine 100 is a diesel engine. The engine 100 mainly includes an engine body 1 and an oil pan 2. The engine body 1 includes a cylinder block 11, a head block 12, and a head cover 13.

A plurality of pistons (not shown) and a crankshaft (not shown) connected to each piston and extending in the front-rear direction are disposed in the cylinder block 11. The crankshaft converts a reciprocating motion of the piston into a rotational motion. A fly wheel (not shown) housed in a fly wheel housing 3 is attached to a rear end of the crankshaft. The flywheel rotates integrally with the crankshaft, and is used to take out power from the engine 100.

The cylinder block 11 has a plurality of cylinders (not shown) arranged in the front-rear direction on each of the left and right sides. Each of the plurality of pistons is disposed in each cylinder. Note that the engine 100 is, for example, a V-type 12-cylinder engine, and the number of cylinders arranged in the front-rear direction in each of the left and right sides is six.

The head block 12 is disposed above each cylinder 14 in an overlapping manner. That is, the engine body 1 includes six head blocks 12 arranged in the front-rear direction on each of the left and right sides. Each of the head blocks 12 has an intake port (not shown) for supplying gas to a combustion chamber including the cylinder, the head block 12, and the piston, and an exhaust port (not shown) for exhausting gas from the combustion chamber.

The head cover 13 is disposed above each head block 12. That is, the engine body 1 has six head covers 13 arranged in the front-rear direction on each of the left and right sides. Each head cover 13 covers an intake valve and an exhaust valve (not shown) disposed at the head block 12. An injector (not shown) is mounted on each head cover 13. One end portion (lower end portion) of the injector on which an injection port for injecting fuel is provided faces the combustion chamber. Each injector injects fuel supplied from a fuel pump 4 that discharges fuel at a high pressure into the combustion chamber at an appropriate timing. The piston is reciprocated by force generated by combustion of fuel injected into the combustion chamber. In the present embodiment, the fuel pump 4 is disposed on the rear side of the left side surface of the engine 100.

A row of the cylinders arranged in the front-rear direction on the left side of the engine 100, and the head block 12 and the head cover 13 disposed on the left side of the engine 100 constitute a left bank LB. A row of the cylinders arranged in the front-rear direction on the right side of the engine 100, and the head block 12 and the head cover 13 disposed on the right side of the engine 100 constitute a right bank RB. That is, the engine 100 is a V-type engine including a first bank and a second bank arranged in the left-right direction. One of the left bank LB and the right bank RB is the first bank, and the other of the left bank LB and the right bank RB is the second bank.

Further, the engine 100 includes an intake manifold 5 and an exhaust manifold 6.

The intake manifold 5 distributes intake air, which is air or air-fuel mixture, supplied from a turbocharger 7 (described in detail later) to each cylinder 14 (combustion chamber). Specifically, the intake manifolds 5 are arranged one by one on the left side surface and the right side surface of the engine body 1 correspondingly to the cylinder rows arranged on the left side and right side respectively. The intake manifolds 5 disposed on the left side and the right side both extend in the front-rear direction. Hereinafter, the intake manifold 5 provided on the left side of the engine 100 correspondingly to the left cylinder row is referred to as a left intake manifold 5L. The intake manifold 5 provided on the right side of the engine 100 correspondingly to the right cylinder row is referred to as a right intake manifold 5R. The left intake manifold 5L and the right intake manifold 5R are disposed outside the V bank constituted by the left bank LB and the right bank RB.

The exhaust manifold 6 collects exhaust air from each cylinder (combustion chamber). The exhaust manifold 6 is disposed to extend in the front-rear direction between the left bank LB and the right bank RB. The exhaust manifold 6 constitutes an exhaust passage. That is, the engine 100 includes an exhaust passage disposed to extend in the front-rear direction between the first bank and the second bank. In detail, two exhaust manifolds 6 are disposed correspondingly to the cylinder rows disposed on the left and right sides respectively. The two exhaust manifolds 6 both extend in the front-rear direction. The two exhaust manifolds 6 are arranged side by side in the left-right direction inside the V bank composed of the left bank LB and the right bank RB. Hereinafter, the exhaust manifold 6 arranged on the left side in the V bank correspondingly to the left cylinder row is referred to as a left exhaust manifold 6L. The exhaust manifold 6 arranged on the right side in the V bank correspondingly to the right cylinder row is referred to as a right exhaust manifold 6R.

The turbocharger 7 is disposed at a rear upper portion of the engine 100. The turbocharger 7 pressurizes and compresses air or air-fuel mixture supplied from an outside of the engine 100 and supplies the pressurized and compressed air or air-fuel mixture to the intake manifold 5 via an intercooler 8. In this embodiment, air purified by a filter 9 indicated by a broken line in FIGS. 1 and 3 is supplied to the turbocharger 7. The turbocharger 7 is a turbocharger that uses the exhaust gas supplied from the exhaust manifold 6 as a drive source.

The intercooler 8 connected to the intake manifold 5 is supplied with cooling water by an operation of a cooling water pump 10 for low-temperature water, to thereby cool the intake air. The intake air supplied from the turbocharger 7 is pressurized and compressed, and thereby generates compression heat and is increased in temperature. The intercooler 8 cools the intake air by heat exchange between the cooling water and the pressurized and compressed intake air. That is, providing the intercooler 8 allows the temperature of the intake air that is to be supplied to the intake manifold 5 to be adjusted to a desired temperature.

Specifically, the turbocharger 7 includes a left turbocharger 7L provided on the left side of the engine 100 and a right turbocharger 7R provided on the right side of the engine 100. The left turbocharger 7L supplies air or the like (intake air) to the left intake manifold 5L via the intercooler 8. The right turbocharger 7R supplies air or the like (intake air) to the right intake manifold 5R via the intercooler 8. The exhaust gas collected by the left exhaust manifold 6L is discharged to the outside via the left turbocharger 7L. The exhaust gas collected by the right exhaust manifold 6R is discharged to the outside via the right turbocharger 7R.

The oil pan 2 is disposed below the cylinder block 11 and stores lubricant oil. The lubricant oil stored in the oil pan 2 is supplied to each part of the engine 100 that requires lubrication.

2. Overview of Cooling System

Figure 4:
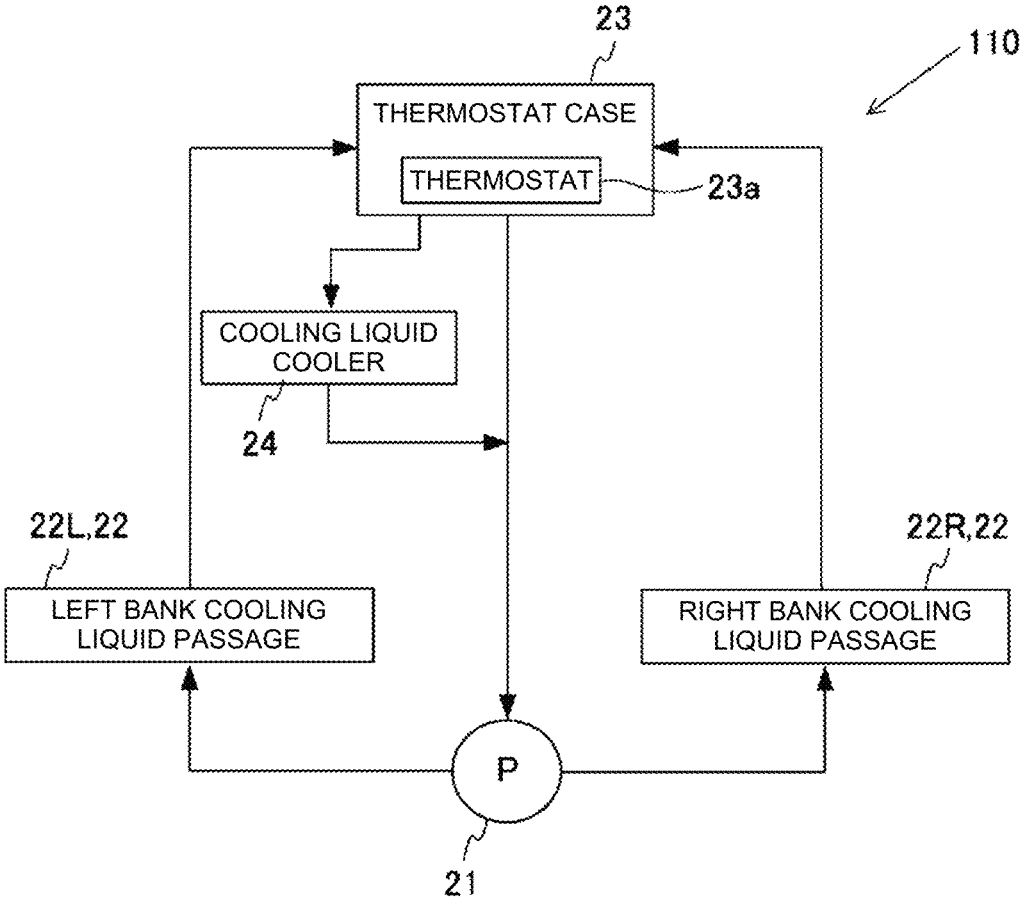
FIG. 4 is a schematic view showing a schematic configuration of a cooling system.

Next, an outline of a cooling system 110 included in the engine 100 will be described. The cooling system 110 described here is a cooling system for cooling the engine body 1. FIG. 4 is a schematic diagram showing a schematic configuration of the cooling system 110.

As shown in FIG. 4, the cooling system 110 includes a cooling liquid pump 21, a cooling liquid passage 22, a thermostat case 23, and a cooling liquid cooler 24. In the present embodiment, the cooling liquid is cooling water. However, the cooling liquid may be a liquid other than water, such as antifreeze, for example. Antifreeze is, for example, liquid mixture of pure water and ethylene glycol in a given ratio.

The cooling liquid pump 21 is a pump for circulating the cooling liquid. By driving the cooling liquid pump 21, the cooling liquid is sent to the cooling liquid passage 22. The cooling liquid pump 21 is driven by rotational power transmitted from the crankshaft via a gear (not shown). In the present embodiment, the cooling liquid pump 21 is a cooling water pump. The cooling liquid pump 21 is a cooling water pump for high-temperature water.

The cooling liquid passage 22 is a passage through which a cooling liquid passes. In the present embodiment, the cooling liquid passage 22 includes a left bank cooling liquid passage 22L and a right bank cooling liquid passage 22R. That is, the cooling liquid is sent from the cooling liquid pump 21 to the left bank cooling liquid passage 22L and the right bank cooling liquid passage 22R. The left bank cooling liquid passage 22L includes a passage for cooling the cylinder block 11 and the head block 12 constituting the left bank LB, and a passage for returning the cooling liquid after cooling the blocks 11 and 12 to the cooling liquid pump 21. The right bank cooling liquid passage 22R includes a passage for cooling the cylinder block 11 and the head block 12 constituting the right bank RB and a passage for returning the cooling liquid after cooling the blocks 11 and 12 to the cooling liquid pump 21.

The thermostat case 23 houses a thermostat 23*a*. The thermostat 23*a* has a function to keep the temperature of the cooling liquid near a set temperature. By the action of the thermostat 23*a*, the cooling liquid sent into the thermostat case 23 is sent to the cooling liquid cooler 24 when cooling is required, and is directly returned to the cooling liquid pump 21 when cooling is not required. The cooling liquid that has passed through the left bank cooling liquid passage 22L and the cooling liquid that has passed through the right bank cooling liquid passage 22R are sent into the thermostat case 23.

The cooling liquid cooler 24 cools the cooling liquid circulating in the cooling liquid passage 22. The cooling liquid cooler 24 is a heat exchanger that cools the cooling liquid using heat exchange. The cooling liquid cooled by the cooling liquid cooler 24 is returned to the cooling liquid pump 21.

The cooling system 110 configured as described above includes two cooling liquid pipes 221 disposed between the left bank LB and the right bank RB and extending in the front-rear direction (see FIG. 3). The cooling liquid pipe 221 constitutes a passage of the cooling liquid. In other words, the engine 100 includes a first cooling liquid passage and a second cooling liquid passage that are disposed between the first bank and the second bank and extend in the front-rear direction. One of the two cooling liquid pipes 221 constitutes the first cooling liquid passage, and the other of the two cooling liquid pipes 221 constitutes the second cooling liquid passage. In detail, the two cooling liquid pipes 221 are arranged side by side in the left-right direction between the left bank LB and the right bank RB. Two cooling liquid pipes 221 include a left cooling liquid pipe 221L disposed on the left side in the V bank and a right cooling liquid pipe 221R disposed on the right side in the V bank. The left cooling liquid pipe 221L and the right cooling liquid pipe 221R have the same height position in the up-down direction.

3. Arrangement of Exhaust Passage

Hereinafter, the arrangement of the exhaust passage provided in the engine 100 will be described in detail. The exhaust passage is formed by the exhaust manifold 6. In the present embodiment, the exhaust passage includes a first exhaust passage and a second exhaust passage that are arranged in the left-right direction. One of the left exhaust manifold 6L and the right exhaust manifold 6R constitutes the first exhaust passage, and the other of the left exhaust manifold 6L and the right exhaust manifold 6R constitutes the second exhaust passage. The left exhaust manifold 6L and the right exhaust manifold 6R have the same height position in the up-down direction.

Figure 5:
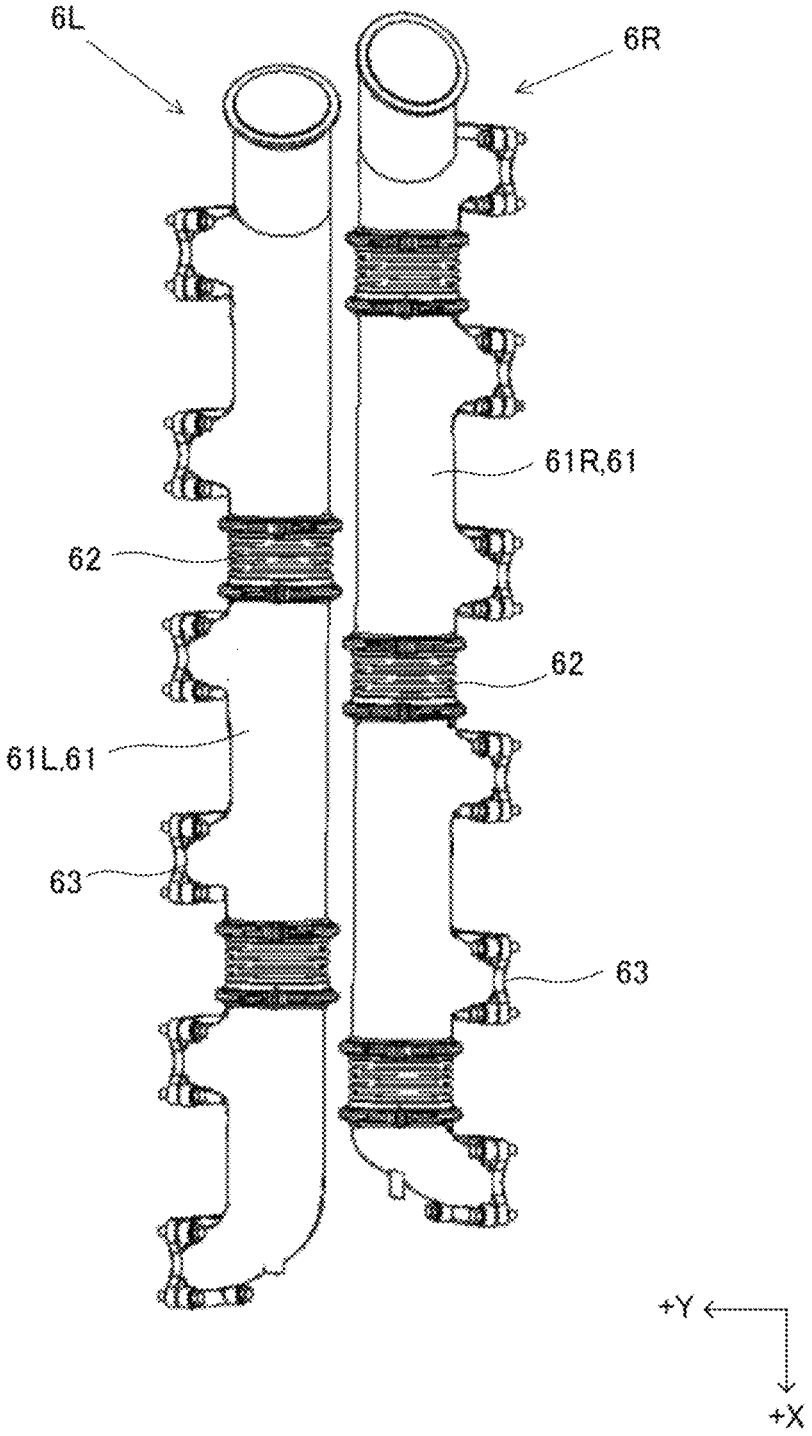
FIG. 5 is a plan view showing a schematic configuration of left and right exhaust manifolds included in the engine.

FIG. 5 is a plan view showing a schematic configuration of the left exhaust manifold 6L and the right exhaust manifold 6R provided in the engine 100 according to the embodiment of the present invention. Each of the left exhaust manifold 6L and the right exhaust manifold 6R has a plurality of pipes 61 and a plurality of bellows 62. The pipes 61 adjacent to each other in the front-rear direction are connected to each other via the bellows 62. Each pipe 61 constitutes an exhaust passage. The bellows 62 is an example of a connecting portion that connects the pipes 61 to each other. That is, each of the first exhaust passage and the second exhaust passage is formed by connecting a plurality of passage portions by the connecting portions.

Specifically, the left exhaust manifold 6L includes three left pipes 61L and two bellows 62. Each left pipe 61L is provided with two exhaust connecting portions 63 connected to the head block 12 disposed on the left side of the engine 100. The exhaust air from each head block 12 enters the left pipe 61L via the exhaust connecting portion 63. The right exhaust manifold 6R includes four right pipes 61R and three bellows 62. One exhaust connecting portion 63 connected to the head block 12 disposed on the right side of the engine 100 is provided on each of the right pipes 61R on the front end and the rear end of the right exhaust manifold 6R. Two exhaust connecting portions 63 connected to the head block 12 disposed on the right side of the engine 100 are provided on each of the two right pipes 61R between the right pipe 61R at the front end and the right pipe 61R at the rear end. The exhaust air from each head block 12 enters the right pipes 61R via the exhaust connecting portions 63.

In the present embodiment, the number of pipes 61 and the number of bellows 62 are different between the left exhaust manifold (left exhaust passage) 6L and the right exhaust manifold (right exhaust passage) 6R, but this is merely an example. The number of pipes 61 and the number of bellows 62 may be the same between the left exhaust manifold 6L and the right exhaust manifold 6R.

As shown in FIG. 5, the left exhaust manifold 6L and the right exhaust manifold 6R are arranged with the positions of the bellows 62 of the left exhaust manifold 6L and the positions of the bellows 62 of the right exhaust manifold 6R being shifted from each other in the front-rear direction. That is, the first exhaust passage and the second exhaust passage are disposed with the positions of the coupling portions of the first exhaust passage and the positions of the coupling portions of the second exhaust passage being shifted from each other in the front-rear direction. Since the bellows 62 is usually connected to the pipe 61 by using a coupling tool such as a band, an outer diameter is large at the connecting portion between the pipe 61 and the bellows 62. In this regard, as in the present embodiment, when the positions of the bellows 62 of the left exhaust manifold 6L and the positions of the bellows 62 of the right exhaust manifold 6R are shifted from each other in the front-rear direction, it is possible to narrow the interval between the left exhaust manifold 6L and the right exhaust manifold 6R while avoiding the contact between the coupling tools such as bands. As a result, the left exhaust manifold 6L and the right exhaust manifold 6R can be disposed at a position (deep position) lower than the upper end portion of the V bank formed between the left bank LB and the right bank RB in the left-right direction. The exhaust manifold 6 (heat source) can be disposed away from the injector and the filter 9 disposed in the upper portion of the engine 100. Further, when the exhaust manifold 6 is disposed in the space between the left bank LB and the right bank RB, it is possible to prevent a worker from approaching the exhaust manifold 6.

In the present embodiment, the height positions of the left exhaust manifold 6L and the right exhaust manifold 6R in the up-down direction are the same as the height position of the head block 12.

Figure 6:
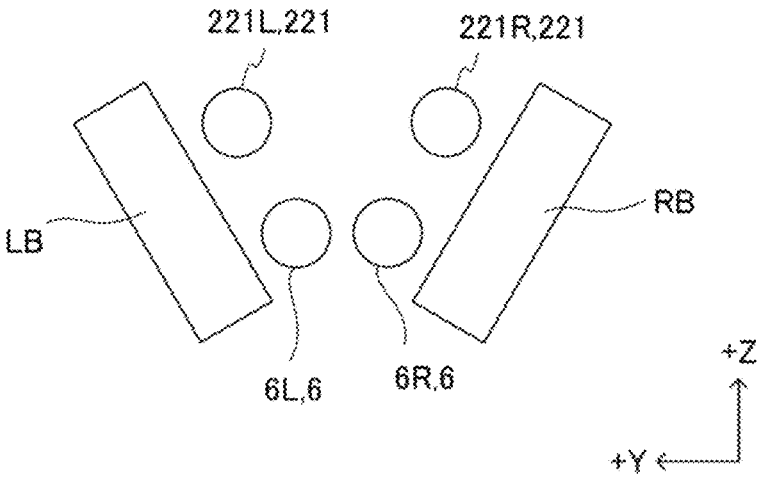
FIG. 6 is a schematic view showing a relationship between the exhaust manifold and a cooling liquid pipe.

FIG. 6 is a schematic view showing a relationship between the exhaust manifold 6 and the cooling liquid pipe 221 in the engine 100. As shown in FIG. 6, the exhaust manifold 6 is disposed below the left cooling liquid pipe 221L and the right cooling liquid pipe 221R. That is, the exhaust passage is disposed below the first cooling liquid passage and the second cooling liquid passage. Since the cooling liquid passage is disposed above the exhaust passage, at least a part of hot air flowing from the exhaust passage to the upper side of the engine 100 can be brought into contact with the member (cooling liquid pipe 221) constituting the cooling liquid passage. The hot air from the exhaust passage can be cooled by utilizing the cooling liquid passage.

The left cooling liquid pipe 221L and the right cooling liquid pipe 221R disposed above the exhaust manifold 6 are disposed above the V bank constituted by the left bank LB and the right bank RB. The height positions of the left cooling liquid pipe 221L and the right cooling liquid pipe 221R in the up-down direction are the same as the height position of the head cover 13.

As shown in FIG. 6, in the engine 100, the left bank LB, the left cooling liquid pipe 221L, the exhaust manifold 6, the right cooling liquid pipe 221R, and the right bank RB are arranged in the stated order from the left side to the right side. That is, the first bank, the first cooling liquid passage, the exhaust passage, the second cooling liquid passage, and the second bank are arranged in the stated order from one side to the other side in the left-right direction. Since the cooling liquid passages are disposed on both sides of the exhaust passage in the left-right direction, hot air from the exhaust passage can be prevented from leaking out in the left-right direction of the engine 100.

Specifically, the left exhaust manifold 6L and the right exhaust manifold 6R are disposed below the left cooling liquid pipe 221L and the right cooling liquid pipe 221R. The left bank LB, the left cooling liquid pipe 221L, the left exhaust manifold 6L, the right exhaust manifold 6R, the right cooling liquid pipe 221R, and the right bank RB are arranged in the stated order from the left side to the right side.

In the present embodiment, the exhaust manifold 6 includes the left exhaust manifold 6L and the right exhaust manifold 6R, but this is merely an example. The exhaust manifold 6 may be configured so that one exhaust manifold is provided and this exhaust manifold collects the exhaust gas from the cylinders of the left bank LB and the right bank RB.

Figure 7:
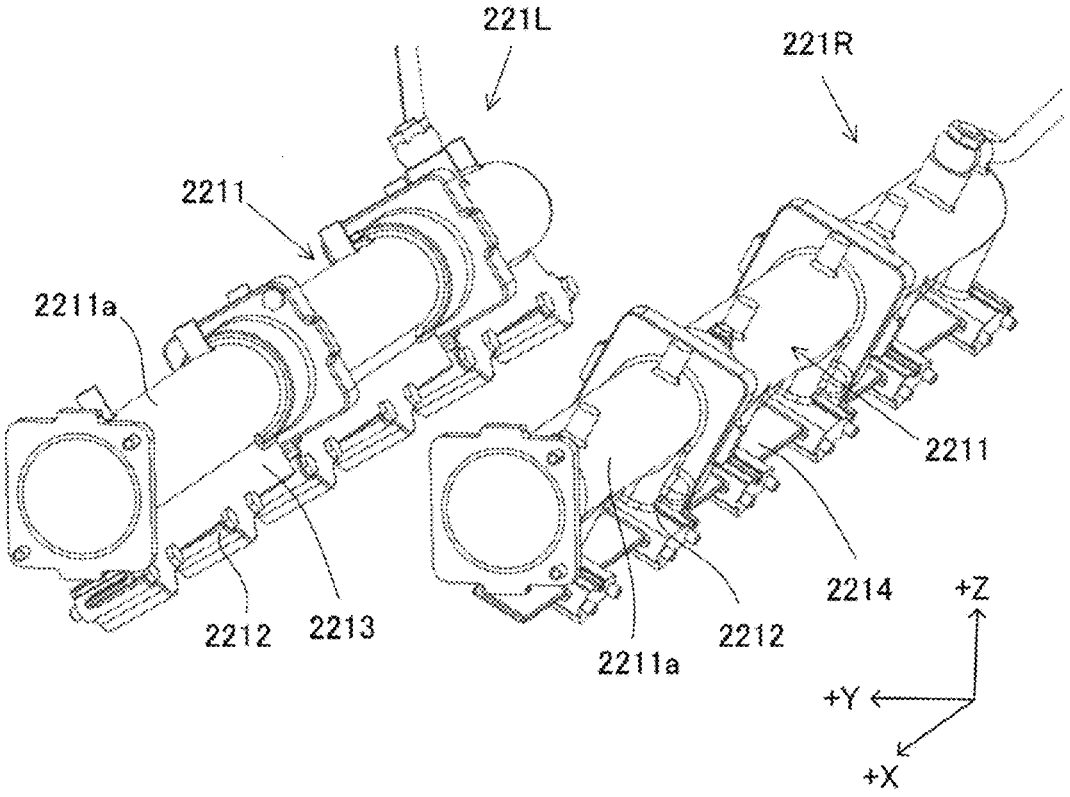
FIG. 7 is a perspective view showing a schematic configuration of a left cooling liquid pipe and a right cooling liquid pipe.

FIG. 7 is a perspective view showing a schematic configuration of the left cooling liquid pipe 221L and the right cooling liquid pipe 221R included in the engine 100 according to the embodiment of the present invention. As shown in FIG. 7, each of the left cooling liquid pipe 221L and the right cooling liquid pipe 221R has a pipe main body portion 2211 extending in the front-rear direction. In detail, the pipe main body portion 2211 is configured by connecting a plurality of pipe members 2211*a* to each other. In this embodiment, the pipe main body portion 2211 of each of the left cooling liquid pipe 221L and the right cooling liquid pipe 221R is configured by connecting three pipe members 2211*a* to each other. However, the pipe main body portion 2211 is not limited to this configuration, and may be formed of a single pipe member or a plurality of pipe members different from three pipe members.

Further, each of the left cooling liquid pipe 221L and the right cooling liquid pipe 221R has a connecting portion 2212 for connecting the pipe main body portion 2211 to the head block 12 included in each of the nearest banks LB, RB. The connecting portion 2212 is L-shaped. One connecting portion 2212 is provided correspondingly to each head block 12. That is, each of the left cooling liquid pipe 221L and the right cooling liquid pipe 221R has six connecting portions 2212.

The bank nearest to the left cooling liquid pipe 221L is the left bank LB. The bank nearest to the right cooling liquid pipe 221R is the right bank RB. In addition, the inside of the connection portion 2212 is hollow, and the cooling liquid that has cooled each head block 12 enters the pipe main body portion 2211 through the inside of the connecting portion 2212.

In addition, each of the left cooling liquid pipe 221L and the right cooling liquid pipe 221R has a first wall portion 2213 extending downward. The left cooling liquid pipe 221L and the right cooling liquid pipe 221R may not necessarily include the first wall portion 2213. However, at least one of the left cooling liquid pipe 221L and the right cooling liquid pipe 221R preferably includes the first wall portion 2213. That is, at least one of the first cooling liquid passage and the second cooling liquid passage preferably has the first wall portion 2213 extending downward.

Specifically, the first wall portion 2213 extends obliquely downward. The first wall portion 2213 of the left cooling liquid pipe 221L extends rightward as it extends downward in a plan view from the front. The first wall portion 2213 of the right cooling liquid pipe 221R extends leftward as it extends downward in a plan view from the front. The first wall portion 2213 of the left cooling liquid pipe 221L and the first wall portion 2213 of the right cooling liquid pipe 221R approach each other as they extend downward. Each of the first wall portions 2213 of the left cooling liquid pipe 221L and the right cooling liquid pipe 221R extends substantially from the front end to the rear end of the pipe main body portion 2211. In the present embodiment, the first wall portion 2213 has a cutout portion at the connecting portion where the pipe members 2211*a* are connected to each other. This cutout portion may be configured to be as narrow as possible and substantially not exist.

Further, each of the left cooling liquid pipe 221L and the right cooling liquid pipe 221R has a second wall portion 2214 extending from the lower end portion of the first wall portion 2213 toward the closer one of the left bank LB and the right bank RB. When the first wall portion 2213 is not provided, the second wall portion 2214 may not be provided. Further, when the first wall portion 2213 is provided to only one of the left cooling liquid pipe 221L and the right cooling liquid pipe 221R, the second wall portion 2214 may be provided only to the cooling liquid pipe to which the first wall portion 2213 is provided. That is, the cooling liquid passage including the first wall portion may include the second wall portion 2214 extending from the lower end portion of the first wall portion 2213 toward the closer one of the left bank LB and the right bank RB.

In detail, the second wall portion 2214 of the left cooling liquid pipe 221L extends toward the left bank LB. The second wall portion 2214 of the left cooling liquid pipe 221L extends obliquely downward to the left. The second wall portion 2214 of the right cooling liquid pipe 221R extends toward the right bank RB. The second wall portion 2214 of the right cooling liquid pipe 221R extends obliquely downward to the right. That is, the second wall portion 2214 of the left cooling liquid pipe 221L and the second wall portion 2214 of the right cooling liquid pipe 221R extend opposite to each other in the left-right direction. Each of the second wall portions 2214 of the left cooling liquid pipe 221L and the right cooling liquid pipe 221R is provided in the same range in the front-rear direction as the range in which the first wall portion 2213 is provided. That is, each of the second wall portions 2214 of the left cooling liquid pipe 221L and the right cooling liquid pipe 221R extends substantially from the front end to the rear end of the pipe main body portion 2211.

Figure 8:
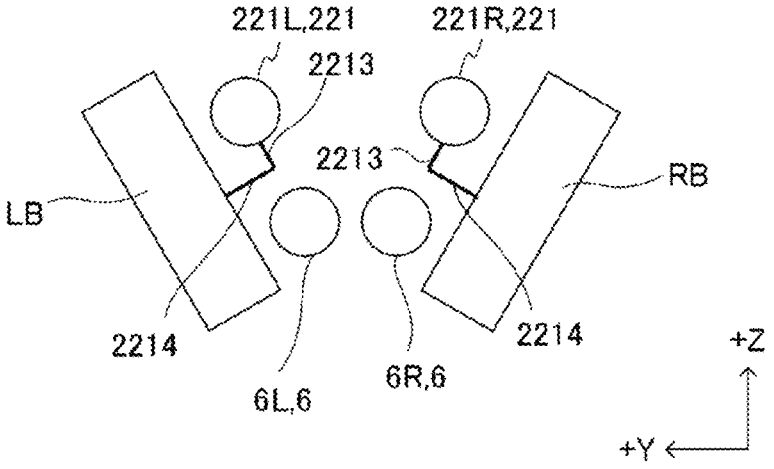
FIG. 8 is a schematic view showing a relationship between the exhaust manifold, a first wall portion, and a second wall portion.

FIG. 8 is a schematic view showing a relationship between the exhaust manifold 6, the first wall portion 2213, and the second wall portion 2214. As shown in FIG. 8, by providing the first wall portion 2213, it is possible to make the hot air from the exhaust manifold (exhaust passage) 6 hardly flow toward the left bank LB and the right bank RB. Further, by providing the second wall portion 2214, it is possible to suppress the hot air from the exhaust manifold 6 from passing between the left cooling liquid pipe 221L and the left bank LB, and between the right cooling liquid pipe 221R and the right bank RB. By providing the first wall portion 2213 and the second wall portion 2214, it is possible to make the hot air from the exhaust manifold 6 hardly flow toward the left bank LB and the right bank RB above the second wall portion 2214.

Further, the first wall portion 2213 and the second wall portion 2214 extend from the cooling liquid pipe 221. For this reason, at least a part of heat of the hot air from the exhaust manifold 6 is collected in the cooling liquid flowing through the cooling liquid pipe (cooling liquid passage) 221 via the first wall portion 2213, or via the second wall portion 2214 and the first wall portion 2213. For this reason, it is possible to suppress the vicinity of the cooling liquid pipe from having an abnormally high temperature. That is, it is possible to suppress thermal damage to components around the cooling liquid pipe 221.

Figure 9A:
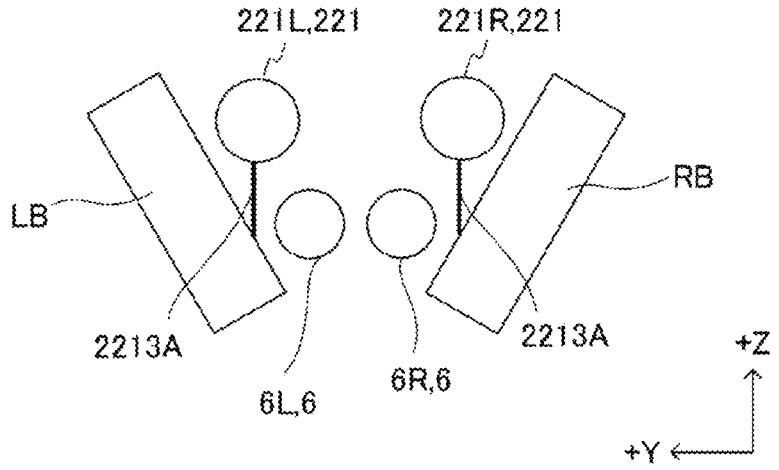
FIG. 9A is a schematic view showing a modified example of a wall portion provided to the cooling liquid pipe.
Figure 9B:
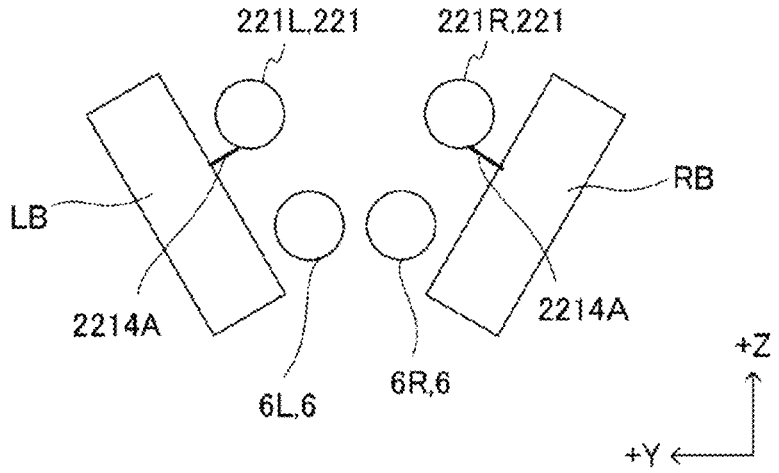
FIG. 9B is a schematic view showing a modified example of a wall portion provided to the cooling liquid pipe.

In the present embodiment, the wall portion provided in the cooling liquid pipe 221 has an L-shape having the first wall portion 2213 and the second wall portion 2214, but this is merely an example. FIG. 9A and FIG. 9B are schematic views showing modified examples of wall portions provided to the cooling liquid pipe 221. For example, as shown in FIG. 9A, the wall portion provided to the cooling liquid pipe 221 may be configured only by the first wall portion 2213A extending downward. Further, for example, as shown in FIG. 9B, the wall portion provided to the cooling liquid pipe 221 may be constituted only by the second wall portion 2214A extending toward the nearest bank of the left bank LB and the right bank RB.

As described above, the engine 100 of the present embodiment includes the filter (intake air filter) 9 that purifies intake air (see FIG. 1 or FIG. 3). Specifically, the filter 9 is an air filter having a cylindrical outer shape. Specifically, the filter 9 includes a left filter 9L for the left bank LB and a right filter 9R for the right bank RB. The left filter 9L is disposed in front of the left turbocharger 7L and supplies purified air to the left turbocharger 7L. The right filter 9R is disposed in front of the right turbocharger 7R and supplies purified air to the right turbocharger 7R. The left filter 9L and the right filter 9R are arranged above the left cooling liquid pipe 221L and the right cooling liquid pipe 221R. That is, the filter 9 is disposed above the first cooling liquid passage.

Figure 10:
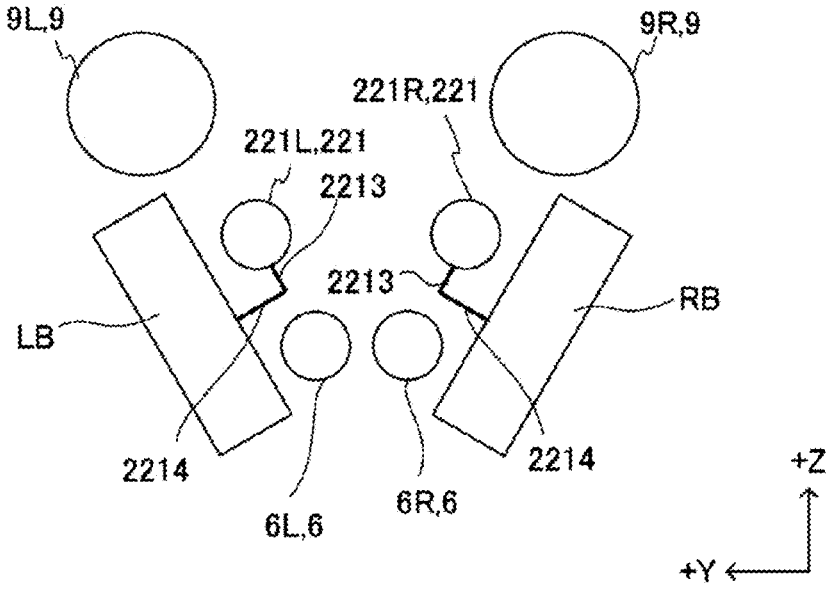
FIG. 10 is a schematic view showing a relationship between an exhaust manifold and a filter.

It is preferable that the filter 9 either overlaps the first cooling liquid passage in a plan view from above, or is disposed on the opposite side of the exhaust passage with the first cooling liquid passage interposed therebetween. FIG. 10 is a schematic view showing a relationship between the exhaust manifold 6 and the filter 9 of the present embodiment.

As shown in FIG. 3 and FIG. 10, in the present embodiment, the left filter 9L is disposed on the opposite side of the left cooling liquid pipe 221L with the left exhaust manifold 6L interposed therebetween. However, the left filter 9L may be disposed at a position overlapping the left cooling liquid pipe 221L in a plan view from above. Further, the right filter 9R is disposed on the opposite side of the right exhaust manifold 6R with the right cooling liquid pipe 221R interposed therebetween. However, the right filter 9R may be disposed at a position overlapping the right cooling liquid pipe 221R in a plan view from above.

With the above configuration, there is a high possibility that the hot air from the exhaust manifold (exhaust passage) 6 reaches the filter 9 after being cooled by the cooling liquid pipe (cooling liquid passage) 221. Therefore, it is possible to suppress hot air from being taken in from the air intake port of the filter 9. That is, decrease in the air supply efficiency can be suppressed.

In the present embodiment, as shown in FIG. 1 and FIG. 3, the engine 100 includes a blow-by gas pipe 50. That is, the engine 100 includes a blow-by gas passage through which blow-by gas passes. Specifically, the blow-by gas that has leaked from the combustion chamber enters the blow-by gas pipe 50 via an oil separator 51 (see FIG. 1 and the like) that is disposed at an upper portion of the front side of the engine 100. The oil separator 51 removes oil components from the blow-by gas. That is, the blow-by gas passing through the blow-by gas pipe 50 is purified gas from which oil components have been removed. The gas that has passed through the blow-by gas pipe 50 is sent to the turbocharger 7 and used as intake air. That is, the blow-by gas passage formed by the blow-by gas pipe 50 is a blow-by gas return passage. As described above, the turbocharger 7 includes the left turbocharger 7L and the right turbocharger 7R. For this reason, the blow-by gas pipe 50 has a branch portion 50*a* (see FIG. 3) for distributing the blow-by gas to the left turbocharger 7L and the right turbocharger 7R. The blow-by gas passage is divided into two passages downstream of the branch portion 50*a*.

The blow-by gas pipe 50 is disposed above the left cooling liquid pipe 221L and the right cooling liquid pipe 221R. That is, the blow-by gas passage is disposed above the first cooling liquid passage. It is preferable that at least a part of the blow-by gas passage either overlaps the first cooling liquid passage in a plan view from above, or is disposed on the opposite side of the exhaust passage with the first cooling liquid passage interposed therebetween.

As shown in FIG. 3, in the present embodiment, a part of the blow-by gas pipe (blow-by gas passage) 50 overlaps the left cooling liquid pipe 221L in a plan view from above. Further, another part of the blow-by gas pipe (blow-by gas passage) 50 overlaps the right cooling liquid pipe 221R in a plan view from above. However, at least a part of the blow-by gas pipe (blow-by gas passage) 50 may be disposed on the side opposite to the exhaust manifold 6 with the cooling liquid pipe 221 interposed therebetween, similarly to the filter 9.

With the above-described configuration, there is a high possibility that hot air from the exhaust manifold (exhaust passage) 6 reaches the blow-by gas passage after being cooled by the cooling liquid pipe (cooling liquid passage) 221. For this reason, it is possible to prevent the gas passing through the blow-by gas passage from being warmed and supplied to the turbocharger 7. That is, decrease in the air supply efficiency can be suppressed.

Figure 11:
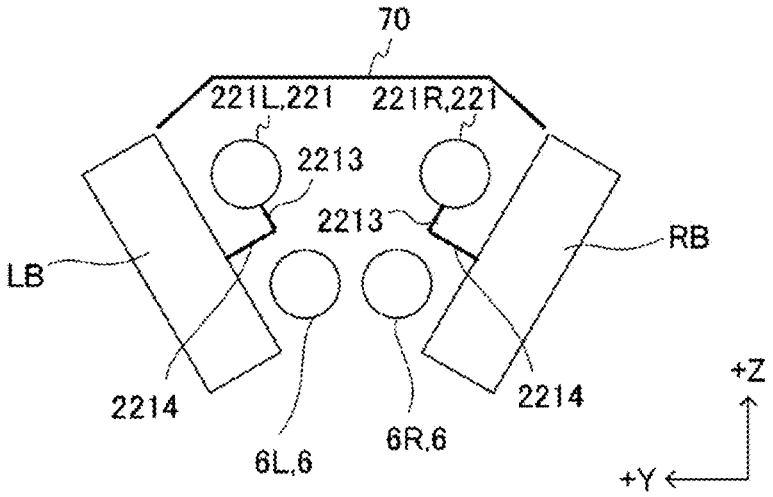
FIG. 11 is a schematic diagram for explaining a preferred embodiment of the engine.

FIG. 11 is a schematic view for explaining a preferred embodiment of the engine 100. As shown in FIG. 11, the engine 100 preferably includes a cover member 70 that covers at least a part of the left cooling liquid pipe 221L, the right cooling liquid pipe 221R, and the exhaust manifold 6. That is, it is preferable that the engine 100 includes the cover member 70 that covers at least a part of the first cooling liquid passage, the second cooling liquid passage, and the exhaust passage. It is possible to reduce the possibility that the hot air from the exhaust passage leaks to the outside from the inside of the V bank constituted by the left bank LB and the right bank RB.

Specifically, the cover member 70 covers a space between the left bank LB and the right bank RB (V-bank internal space). In the present embodiment, the cover member 70 is positioned below the filter 9 and the blow-by gas pipe 50. The cover member 70 is positioned below the upper end portion of the injector protruding from the upper portion of the head cover 13. That is, by providing the cover member 70, it is possible to reduce the possibility that the intake air is heated by the hot air from the exhaust passage or the electronic components are damaged by heat.

4. Notes, etc.

The various technical features disclosed in the present specification can be modified in various ways without departing from the gist of the technical creation thereof. That is, the above embodiments should be considered exemplary in all respects and not restrictive. In addition, the multiple embodiments and modified examples shown in the present specification may be combined to the extent possible.

5. Appendices

An exemplary engine herein may be an engine of a configuration (first configuration) that is a V-type engine comprising a first bank and a second bank arranged side by side in a left-right direction, the engine comprising: a first cooling liquid passage and a second cooling liquid passage disposed between the first bank and the second bank and extending in a front-rear direction; and an exhaust passage disposed between the first bank and the second bank and extending in a front-rear direction and disposed below the first cooling liquid passage and the second cooling liquid passage.

The engine of the above-described first configuration may have a configuration (second configuration) in which the first bank, the first cooling liquid passage, the exhaust passage, the second cooling liquid passage, and the second bank are arranged in the stated order from one side to another side in a left-right direction.

The engine of the above-described second configuration may have a configuration (third configuration) in which at least one of the first cooling liquid passage and the second cooling liquid passage includes a first wall portion extending downward.

The engine of the above-described third configuration may have a configuration (fourth configuration) in which the cooling liquid passage including the first wall portion includes a second wall portion extending from a lower end portion of the first wall portion toward a closer one of the first bank and the second bank.

The engine of any one of the above-described first to fourth configurations may have a configuration (fifth configuration) in which the exhaust passage includes a first exhaust passage and a second exhaust passage arranged side by side in a left-right direction, the first exhaust passage and the second exhaust passage are formed by connecting a plurality of passage portions by connecting portions, and the first exhaust passage and the second exhaust passage are disposed with a position of the connecting portion of the first exhaust passage and a position of the connecting portion of the second exhaust passage being shifted in a front-rear direction.

The engine of any one of the above-described first to fifth configurations may have a configuration (sixth configuration) in which the engine further comprising an intake filter disposed above the first cooling liquid passage, wherein the intake filter either overlaps the first cooling liquid passage in a plan view from above, or is disposed on an oppose side of the exhaust passage with the first cooling liquid passage interposed therebetween.

The engine of any one of the above-described first to sixth configurations may have a configuration (seventh configuration) in which the engine further comprising a blow-by gas passage disposed above the first cooling liquid passage, wherein at least a part of the blow-by gas passage either overlaps the first cooling liquid passage in a plan view from above, or is disposed on an opposite side of the exhaust passage with the first cooling liquid passage interposed therebetween.

The engine of any one of the above-described first to seventh configurations may have a configuration (eighth configuration) in which the engine further comprising a cover member that covers at least a part of the first cooling liquid passage, the second cooling liquid passage, and the exhaust passage.

REFERENCE SIGNS LIST

6 exhaust manifold (exhaust passage)
6L left exhaust manifold (first exhaust passage or second exhaust passage)
6R right exhaust manifold (first exhaust passage or second exhaust passage)
9 filter
50 blow-by gas pipe (blow-by gas passage)
70 cover member
100 engine
221L left cooling liquid pipe (first cooling liquid passage or second cooling liquid passage)
221R right cooling liquid pipe (first cooling liquid passage or second cooling liquid passage)
2213, 2213A first wall portion
2214, 2214A second wall portion LB left bank (first bank or second bank)

RB right bank (first bank or second bank)

The invention claimed is:

1. An engine that is a V-type engine comprising a first bank and a second bank arranged side by side in a left-right direction, the engine comprising:

a first cooling liquid passage and a second cooling liquid passage disposed between the first bank and the second bank and extending in a front-rear direction; and an exhaust manifold passage disposed inside a space formed between the first bank and the second bank and extending in the front-rear direction and disposed below the first cooling liquid passage and the second cooling liquid passage, passage, wherein the first bank, the first cooling liquid passage, the exhaust manifold passage, the second cooling liquid passage, and the second bank are arranged in the stated order from one side to another side in the left-right direction, at least one of the first cooling liquid passage and the second cooling liquid passage includes a first wall portion extending downwards; and the cooling liquid passage including the first wall portion includes a second wall portion extending from a lower end portion of the first wall portion toward a closer one of the first bank and the second bank.

2. An engine that is a V-type engine comprising a first bank and a second bank arranged side by side in a left-right direction, the engine comprising:

a first cooling liquid passage and a second cooling liquid passage disposed between the first bank and the second bank and extending in a front-rear direction, an exhaust manifold passage disposed between the first bank and the second bank and extending in the front-rear direction and disposed below the first cooling liquid passage and the second cooling liquid passage, wherein the first bank, the first cooling liquid passage, the exhaust manifold passage, the second cooling liquid passage, and the second bank are arranged in the stated order from one side to another side in the left-right direction, at least one of the first cooling liquid passage and the second cooling liquid passage includes a first wall portion extending downwards; and the cooling liquid passage including the first wall portion includes a second wall portion extending from a lower end portion of the first wall portion toward a closer one of the first bank and the second bank.

3. An engine that is a V-type engine comprising a first bank and a second bank arranged side by side in a left-right direction, the engine comprising:

a first cooling liquid passage and a second cooling liquid passage disposed between the first bank and the second bank and extending in a front-rear direction; and an exhaust manifold passage disposed between the first bank and the second bank and extending in the front-rear direction and disposed below the first cooling liquid passage and the second cooling liquid passage, wherein the exhaust manifold passage includes a first exhaust passage section and a second exhaust passage section arranged side by side in the left-right direction, the first exhaust passage section and the second exhaust passage section are formed by connecting a plurality of portions of the exhaust manifold passage by corresponding connecting portions, and the first exhaust passage section and the second exhaust passage section are disposed with a position of the corresponding connecting portion of the first exhaust passage section and a position of the corresponding connecting portion of the second exhaust passage section being offset in the front-rear direction.

4. The engine according to claim 1, further comprising an intake filter disposed above the first cooling liquid passage, wherein the intake filter either overlaps the first cooling liquid passage in a plan view from above, or is disposed on an opposite side of the exhaust manifold passage with the first cooling liquid passage interposed therebetween.

5. The engine according to claim 1, further comprising a blow-by gas passage disposed above the first cooling liquid passage, wherein at least a part of the blow-by gas passage either overlaps the first cooling liquid passage in a plan view from above, or is disposed on an opposite side of the exhaust manifold passage with the first cooling liquid passage interposed therebetween.

6. The engine according to claim 1, further comprising a cover member that covers at least a part of the first cooling liquid passage, the second cooling liquid passage, and the exhaust manifold passage.

* * * * *